US010052563B2

(12) United States Patent
Nuttall et al.

(10) Patent No.: US 10,052,563 B2
(45) **Date of Patent: *Aug. 21, 2018**

(54) EXPANDING TRACK SET

(71) Applicant: Mattel, Inc., El Segundo, CA (US)

(72) Inventors: Michael W Nuttall, South Pasadena, CA (US); Stacy Lynn O'Connor, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 220 days.

This patent is subject to a terminal disclaimer.

(21) Appl. No.: 15/085,850

(22) Filed: Mar. 30, 2016

(65) Prior Publication Data

US 2016/0206966 A1 Jul. 21, 2016

Related U.S. Application Data

(63) Continuation of application No. 14/044,104, filed on Oct. 2, 2013, now Pat. No. 9,314,703.

(60) Provisional application No. 61/709,251, filed on Oct. 3, 2012.

(51) Int. Cl.
*A63H 18/02* (2006.01)

(52) U.S. Cl.
CPC ..... *A63H 18/02* (2013.01)

(58) Field of Classification Search
CPC ..... A63H 13/00; A63H 13/04; A63H 17/00; A63H 17/004; A63H 18/00; A63H 18/02; A63H 18/025; A63H 18/04; A63H 18/06
See application file for complete search history.

(56) References Cited

U.S. PATENT DOCUMENTS

| | | | |
|---|---|---|---|
| 1,277,702 | A | 9/1918 | Des Combes |
| 3,621,602 | A | 11/1971 | Barcus et al. |
| 3,713,654 | A | 1/1973 | Goldfarb |
| 4,094,089 | A | 6/1978 | Sano |
| 4,867,723 | A | 9/1989 | Asbach |
| 5,234,216 | A | 8/1993 | Ostendorff |
| 5,334,073 | A | 8/1994 | Tilbor et al. |
| 5,397,260 | A | 3/1995 | Tilbor et al. |
| 5,542,668 | A | 8/1996 | Casale et al. |
| 6,358,112 | B1 | 3/2002 | Lambert et al. |
| 6,913,508 | B2 | 7/2005 | Hornsby et al. |
| 7,537,509 | B2 | 5/2009 | Payne et al. |

(Continued)

FOREIGN PATENT DOCUMENTS

| | | |
|---|---|---|
| WO | 2007056482 | 5/2007 |

OTHER PUBLICATIONS

United States Patent and Trademark Office, Office Action for U.S. Appl. No. 14/044,104, dated Mar. 10, 2015, 15 pages.

(Continued)

*Primary Examiner* — Robert J McCarry, Jr.
(74) *Attorney, Agent, or Firm* — Kolisch Hartwell, P.C.

(57) ABSTRACT

A toy vehicle track set is provided including a track segment. The track set having: a track segment for a toy vehicle; a contact member mounted adjacent to the track segment and configured to be actuated by a toy vehicle on the track segment; and a character adjacent to the track segment, the character including a first portion and at least a second portion movably coupled to the first portion, wherein the at least a second portion moves relative to the first portion in response to actuation of the contact member by a toy vehicle.

20 Claims, 5 Drawing Sheets

(56) References Cited

U.S. PATENT DOCUMENTS

| | | | | |
|---|---|---|---|---|
| 7,575,496 | B2 | 8/2009 | Lau et al. | |
| 7,628,673 | B2 | 12/2009 | Bedford et al. | |
| 7,628,674 | B2 | 12/2009 | Nuttall et al. | |
| 7,690,964 | B2 * | 4/2010 | Nuttall | A63H 18/06 446/168 |
| 7,794,301 | B2 | 9/2010 | Ostendorff et al. | |
| 7,819,720 | B2 | 10/2010 | Nuttall et al. | |
| 7,857,679 | B2 | 12/2010 | O'Connor et al. | |
| 7,892,068 | B2 | 2/2011 | Nuttall et al. | |
| 8,006,943 | B2 | 8/2011 | O'Connor | |
| 8,057,276 | B2 | 11/2011 | O'Connor | |
| 8,137,151 | B2 | 3/2012 | Kenney | |
| 8,182,308 | B2 | 5/2012 | Payne | |
| 9,314,703 | B2 * | 4/2016 | Nuttall | A63H 18/02 |
| 2010/0273394 | A1 | 10/2010 | O'Connor et al. | |
| 2011/0269369 | A1 | 11/2011 | O'Connor et al. | |
| 2011/0294395 | A1 | 12/2011 | O'Connor et al. | |
| 2011/0294396 | A1 | 12/2011 | O'Connor et al. | |

OTHER PUBLICATIONS

United States Patent and Trademark Office, Office Action for U.S. Appl. No. 14/044,104, dated Sep. 4, 2015, 7 pages.

* cited by examiner

EXPANDING TRACK SET

CROSS-REFERENCE TO RELATED APPLICATIONS

This application is a continuation of U.S. patent application Ser. No. 14/044,104 filed Oct. 2, 2013 and entitled EXPANDING TRACK SET, which claims the benefit of U.S. Provisional Patent Application Ser. No. 61/709,251 filed Oct. 3, 2012. The complete disclosures of the above applications are hereby incorporated by reference for all purposes.

BACKGROUND

Various embodiments of the present invention are related to toys, in particular, a track set for toy vehicles to travel on.

Toy vehicle track sets have been popular for many years and generally include one or more track segments arranged to form a path around which one or more toy vehicles can travel. Toy vehicles which may be used on such track sets may be either self-powered vehicles or may receive power from an external source.

Accordingly, it is desirable to provide a toy track set with features that provide unique paths for the toy vehicles of the toy track to travel on.

BRIEF SUMMARY OF INVENTION

In one embodiment, a toy vehicle track set is provided including at least one track segment. A movable character is associated with the at least one track segment. The character includes a pair of appendages positioned adjacent the track segment. At least one of the pair of appendages is movably secured thereto and is configured to intermittently block portions of the track segment. A toy vehicle travelling on the track segment is periodically captured by the character depending on the location of the appendages.

In another embodiment, a toy vehicle track set is provided. The toy vehicle track set having: a track segment; and a movable character located proximate to the track segment, wherein the character includes a torso, a first appendage, and a second appendage, each of the appendages is positioned adjacent the track segment, at least one of the pair of appendages being movably secured thereto and configured to intermittently block portions of the track segment such that a toy vehicle travelling thereon is captured by the character depending on the location of the appendages.

In yet another embodiment, a toy vehicle track set is provided. The toy vehicle track set having: a track segment; and a transforming character located proximate to the track segment, the transforming character including a torso, a first arm coupled to the torso, a second arm coupled to the torso, a first panel coupled to the torso, and a second panel coupled to the torso, the first arm being movably coupled to the torso and positionable proximate to a toy vehicle path defined by the track segment, wherein a toy vehicle traveling on the toy vehicle path can engage the first arm.

In still yet another embodiment, a toy vehicle track set is provided. The toy vehicle track set having: a track segment for a toy vehicle, the track segment including a contact member; and a transforming character located proximate to the track segment, the transforming character including a torso, a pair of appendages coupled to the torso, and a pair of body portions movably coupled to the torso, wherein subsequent actuations of the contact member by the toy vehicle causes the body portions to move relative to the torso away from each other.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
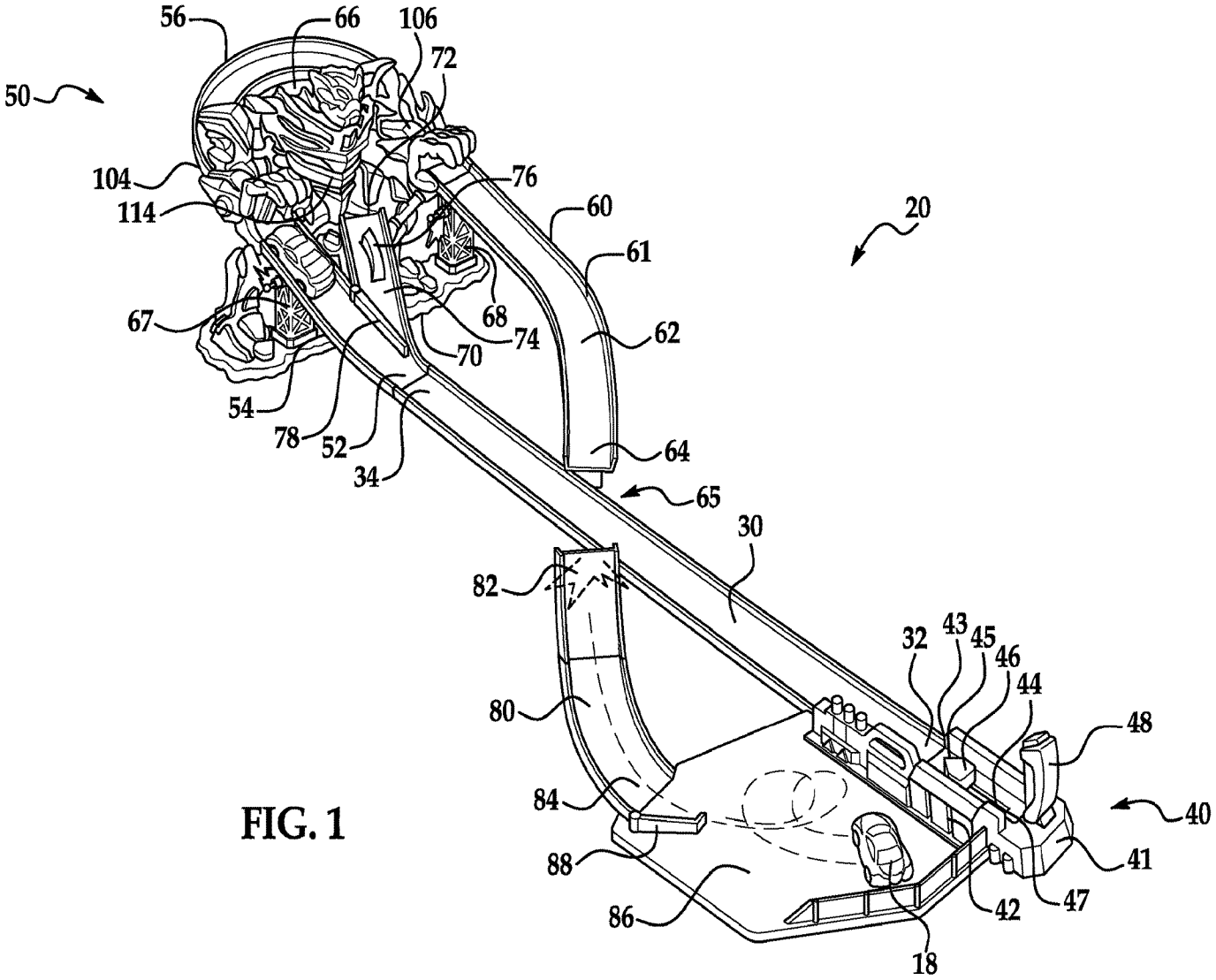
FIG. 1 is a perspective view of a track set according to an embodiment of the invention.

Referring now to FIGS. 1-4, a track set 20 configured for use on a substantially planar playing surface 16 includes a plurality of track segments, for example a first track segment 30, a second track segment 50, and a third track segment 80. The plurality of track segments provides at least one path of travel for a toy, such as a toy vehicle 18.

A launcher 40 is connected to a first end 32 of the first track segment 30. The launcher 40 includes a generally planar base 42 having a substantially elongated slot 44 within which a movable striker 46 is supported. The striker 46 is configured to slide between a first position (FIG. 1) adjacent a first end 45 of the slot 44 and a second position adjacent the opposite end 47 of the slot 44. An upwardly extending handle 48 is pivotally mounted adjacent the first end 41 of the launcher 40. The handle 48 is coupled to the striker 46 such that when the handle 48 is pivoted away from the first track segment 30, the striker 46 slides within the slot 44 from the first position to the second position. A biasing means (not shown), such as a spring for example, biases the striker 46 to the first position. When the handle 48 is released from a pivoted position, the biasing force of the biasing means causes the striker 46 to move within the slot 44 from the second position to the first position. This movement of the striker 46 is transferred to a toy vehicle 18 when it is positioned adjacent the second end 43 of the launcher 40, thereby launching the toy vehicle 18 along the first track segment 30. In one embodiment, the first track segment 30 is substantially straight.

A first end 52 of the second track segment 50 is connected to the second end 34 of the first track segment 30. The second track segment 50 includes a first generally straight portion 54 connected to a second substantially straight portion 60 by a first generally curved portion 56. In one embodiment, the first curved portion 56 is generally U-shaped such that the first linear portion 54 and the second linear portion 60 are substantially parallel. A second generally curved portion 62 is connected to a second end 61 of the second linear portion 60. In one embodiment, the second curved portion 62 curves from the second linear portion 60 toward the first track segment 30. The second track segment 50 is arranged at an angle relative to the first track segment 30 and the planar playing surface 16 such that a first support 67 and a second support 68 retain the first and second linear portions 54, 60 respectively in a position above the planar playing surface 16. Additionally, a third support (not shown) is configured to retain the second, unconnected end 64 of the second curved portion 62 in an elevated position relative to the first track segment 30.

A ramp 70 having an unconnected end 72 extends at an angle adjacent the first end 52 of the second track segment 50 towards the center of the opening 66 formed by the second track segment 50. In one embodiment, a stop gate 76 protrudes from the surface 74 of the ramp 70. The stop gate 76 is configured to move between a first protruding position, shown in FIGS. 1-3, and a second retracted position (see FIG. 4) wherein the stop gate 76 is flush with the surface 74 of the ramp 70. When in the first position, the stop gate 76 is arranged to divert a toy vehicle 18 in a direction away from the unconnected end 72 of the ramp 70. When in the second, retracted position, the stop gate 76 does not interfere with the travel of a toy vehicle 18 along the ramp 70. Mounted about the first end 52 of the second track segment 50 is a diverter 78. The diverter 78 is configured to pivot back and forth between a first position and a second position. When the diverter 78 is in a first position (see FIG. 1), toy vehicles 18 travel from the first track segment 30 to the first linear portion 54 of the second track segment 50 along a first path of travel. When the diverter 78 is rotated to the second position (see FIG. 4), the diverter 78 blocks the path to the first linear portion 54, such that toy vehicle 18 travels toward the unconnected end 72 of the ramp 70 along a second, alternate path of travel.

A first end 82 of the third track segment 80 is arranged adjacent a portion of the first track segment 30, and opposite the second end 64 of the second track segment 50 such that a path of travel exists from the second track segment 50 to the third track segment 80. In one embodiment, the first end 82 of the third track segment 80 is also supported in a position above the planar playing surface 16. Connected to the second end 84 of the third track segment 80 is a platform 86 upon which the toy vehicle 18 is configured to stop. In one embodiment, the platform 86 is connected to the launcher 40 and first end 32 of the first track segment 30. Mounted adjacent the second end 84 of the third track segment 80 and the platform 86 is a lever 88. The lever 88 extends into the path of travel of a toy vehicle 18 onto the platform 86 and is configured to cause a toy vehicle 18 to spin to a stop on the platform 86.

Figure 2:
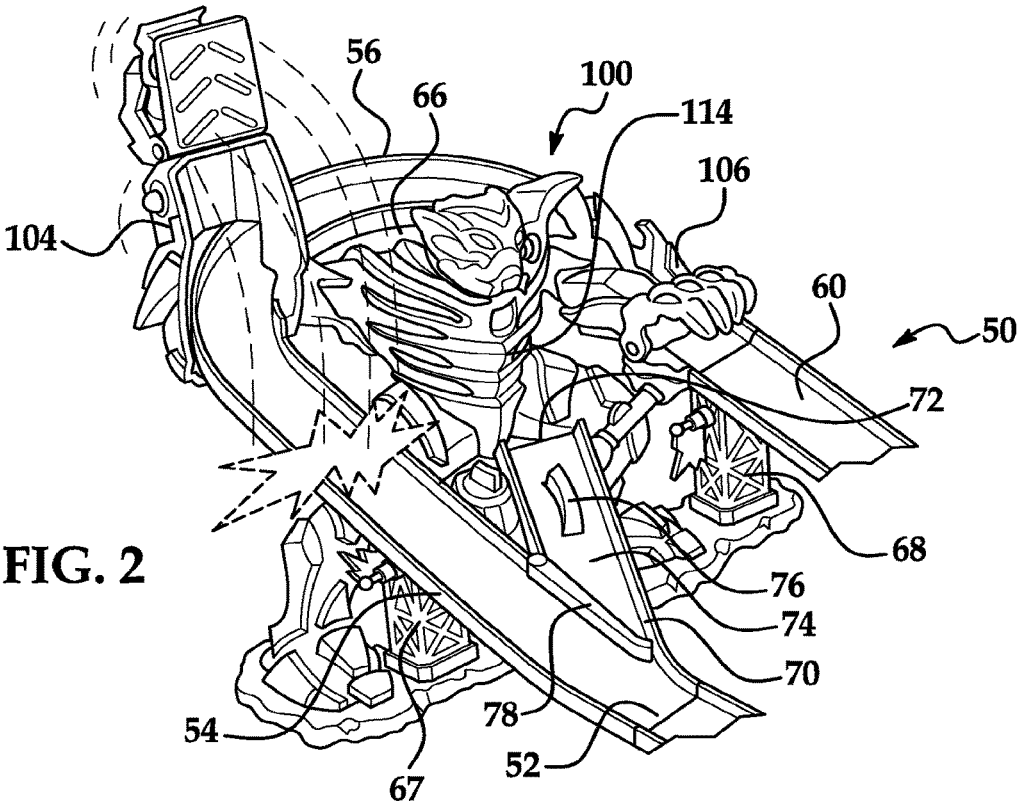
FIG. 2 is a perspective view of a portion of the track set shown in FIG. 1 according to an embodiment of the invention.
Figure 3:
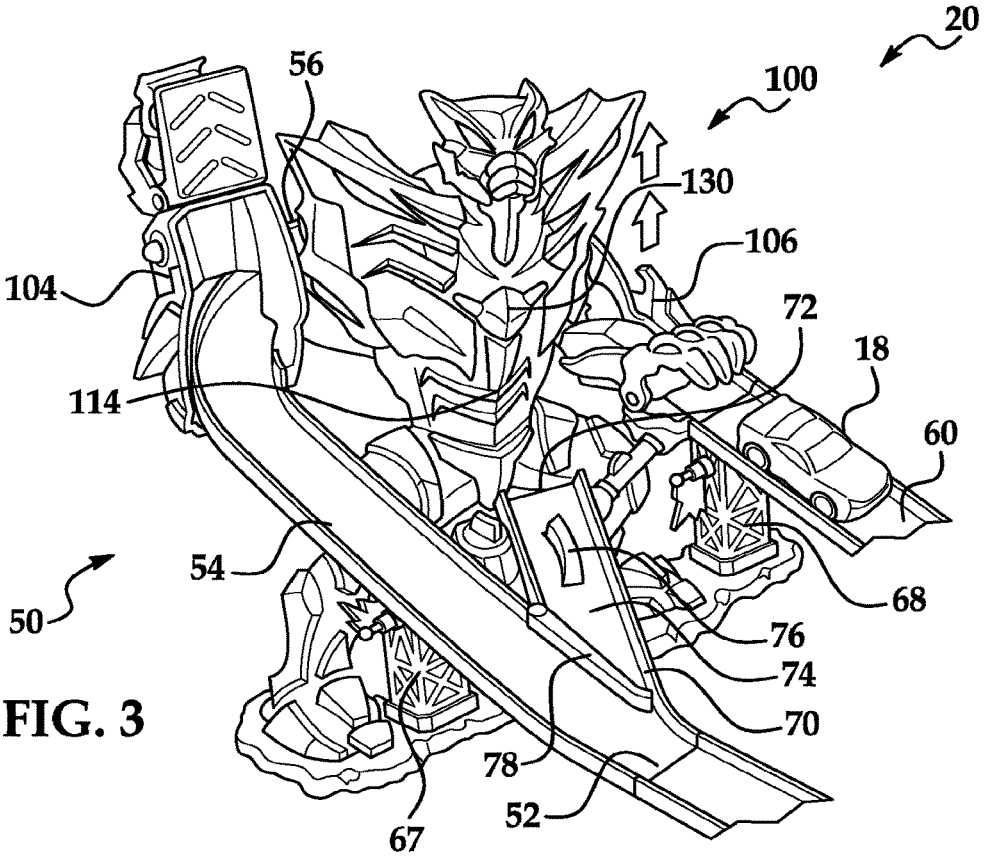
FIG. 3 is a perspective view of the portion of the track set shown in FIG. 2 according to an embodiment of the invention.
Figure 5:
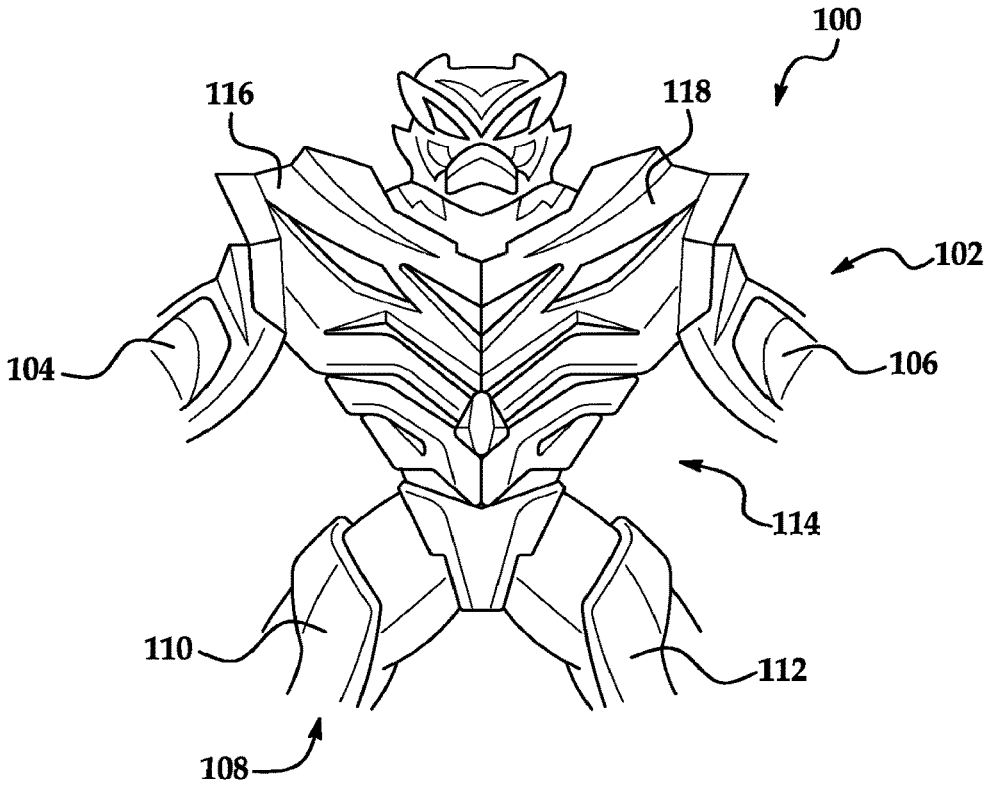
FIG. 5 is a character associated with the track set in a first stage according to an embodiment of the invention.

In one embodiment, a character 100 is positioned within the central opening 66 formed by the second track segment 50 (see FIG. 2). Referring now to FIGS. 5-8, the character 100 is described in more detail. The character 100 may include a first pair of appendages 102, such as arms 104, 106 for example, and a second pair of appendages 108, such as legs 110, 112 for example, coupled to a torso 114. It should be appreciated that in some embodiments, the arms 104, 106 and legs 110, 112 may include additional features such as simulated hands or feet (not shown). The character 100 includes a mechanism (not shown) that increments or indexes in response to impacts to one of the appendages by a toy vehicle 18 that engages or passes by one of the appendages. In one embodiment, the torso 114 is configured to expand vertically and horizontally in multiple stages in response to each interaction of a toy vehicle 18 with one of the appendages. The torso 114 of the character 100 includes a first body panel or body portion 116 and a second symmetrical body panel or body portion 118. When the character 100 is in the first stage, as shown in FIG. 5, the first and second body panels 116, 118 are directly adjacent one another as well as the legs 110, 112 of the character 100.

Figure 6:
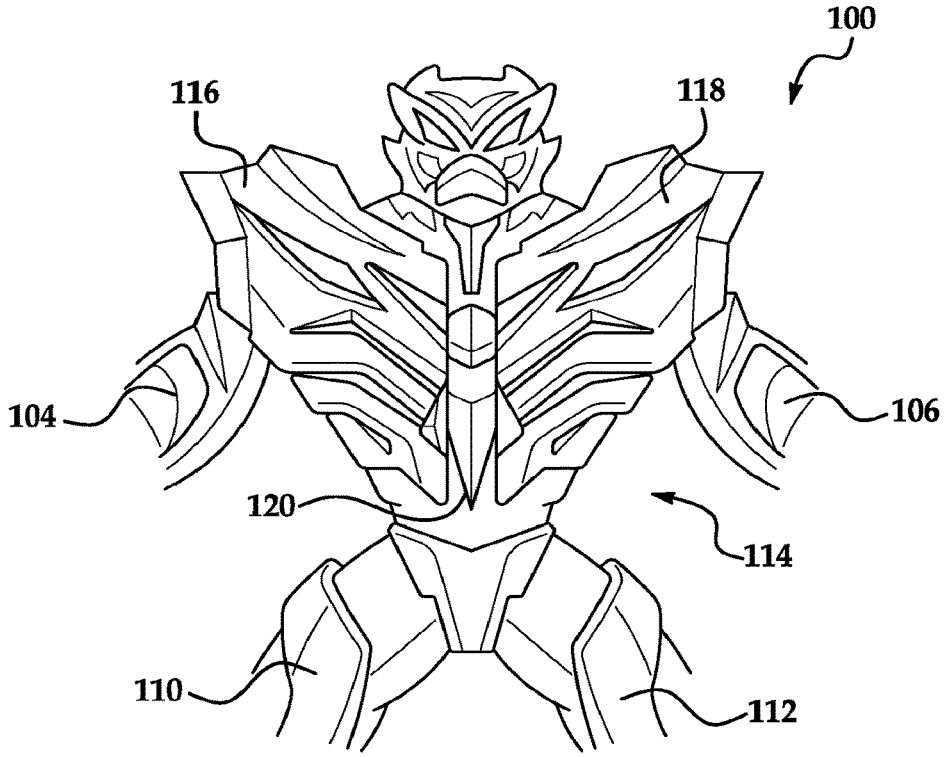
FIG. 6 is a character associated with the track set in a second stage according to an embodiment of the invention.
Figure 7:
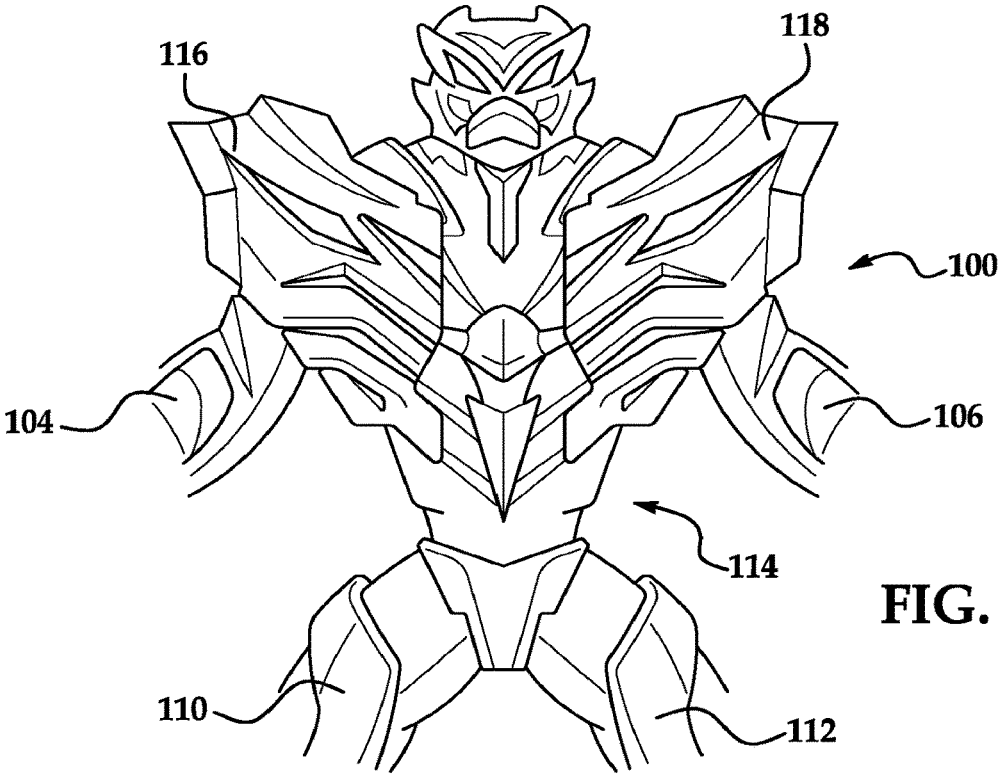
FIG. 7 is a character associated with the track set in a third stage according to an embodiment of the invention.
Figure 8:
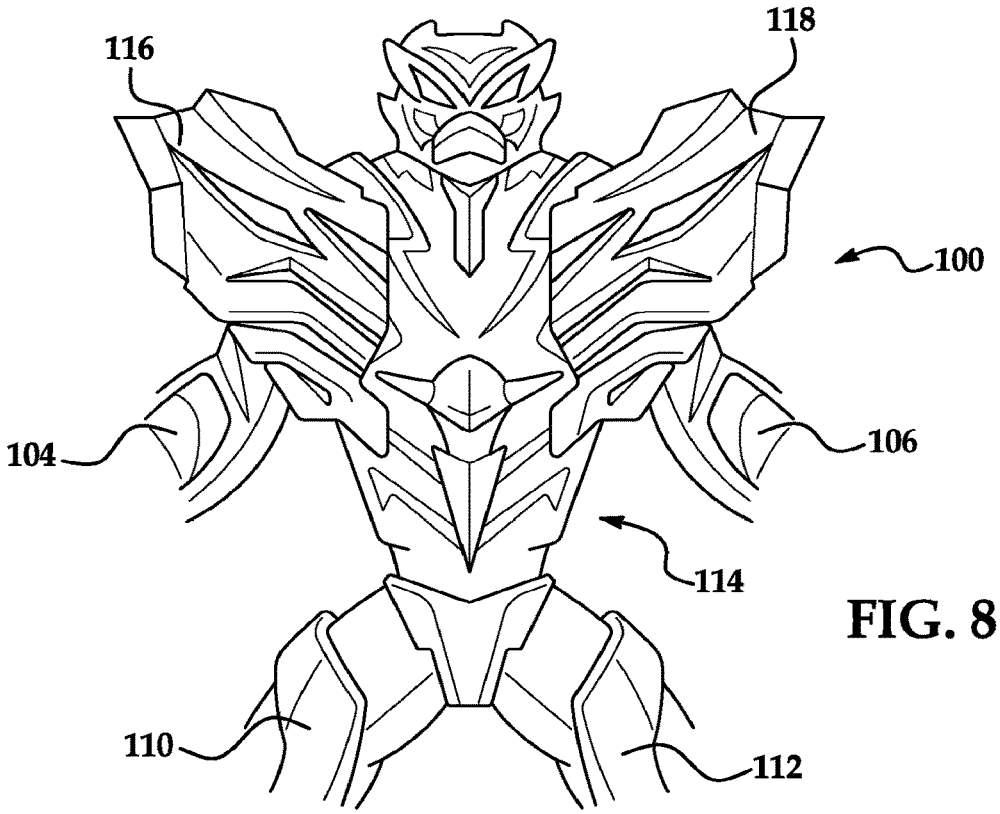
FIG. 8 is a character associated with the track set in a fourth stage according to an embodiment of the invention.

In response to a toy vehicle 18 passing or impacting the character 100, the torso 114 of the character 100 lengthens a first predetermined amount, such that the body panels 116, 118 are no longer positioned directly adjacent the legs 110, 112 (FIG. 6). In this second stage, the pair of body panels 116, 118 are also horizontally spaced apart such that a gap 120 exists between the first body panel 116 and the second body panel 118. The gap 120 is located between the edges of the panels 116, 118. After a second interaction with a toy vehicle 18 (FIG. 7), the character 100 transforms to a third stage wherein the torso 114 of the character 100 lengthens a second predetermined amount and gap 120 between the first and second body panels 116, 118 increases. When the character 100 transforms to a fourth stage after a third interaction with a toy vehicle 18, as shown in FIG. 8, the torso 114 of the character 100 lengthens a third predetermined amount to a fully lengthened position and the body panels 116, 118 translate to a fully open position. As the torso 114 of the character 100 transforms with each interaction with the toy vehicle 18, the body panels 116, 118 separate to reveal a spring-loaded actuator 130 (see FIG. 3) underneath. In one embodiment, the torso 114 of the character 100 is configured to separate from the remaining portion of the character 100 when a toy vehicle 18 applies a force to the spring-loaded actuator 130. By reconnecting the separated torso 114 with the remaining portion of the character 100, the torso 114 is returned to its first stage.

As illustrated in FIGS. 1-4, the character 100 is positioned within the central opening 66 of the second track segment 50 such that the torso 114 of the character 100 is adjacent the second track segment 50. In one embodiment, a portion of the character 100 may provide support for the first and second linear portions 54, 60 of the second track segment 50. A pair of appendages 102, such as the first arm 104 and second arm 106 for example, cross and are movably secured to the second track segment 50. In one embodiment, the first arm 104 is positioned adjacent the first linear portion 54 and a second arm 106 is positioned adjacent the second linear portion 60 of the second track segment 50. The first arm 104 is rotatable between a first position and a second position to intermittently block a portion of the path of travel along the second track segment 50. In the first position, the first arm 104 is arranged parallel to the first linear portion 54 (FIG. 1). Upon impact from a toy vehicle 18, the first arm 104 rotates to a second position, perpendicular to the second track segment 50 and out of the path of travel of a toy vehicle 18 (FIG. 2). In one embodiment, the first arm 104 is removably attached to the torso 114, such that when the torso 114 separates from the remainder of the character 100, the arm 104 remains coupled to the second track segment 50.

Figure 4:
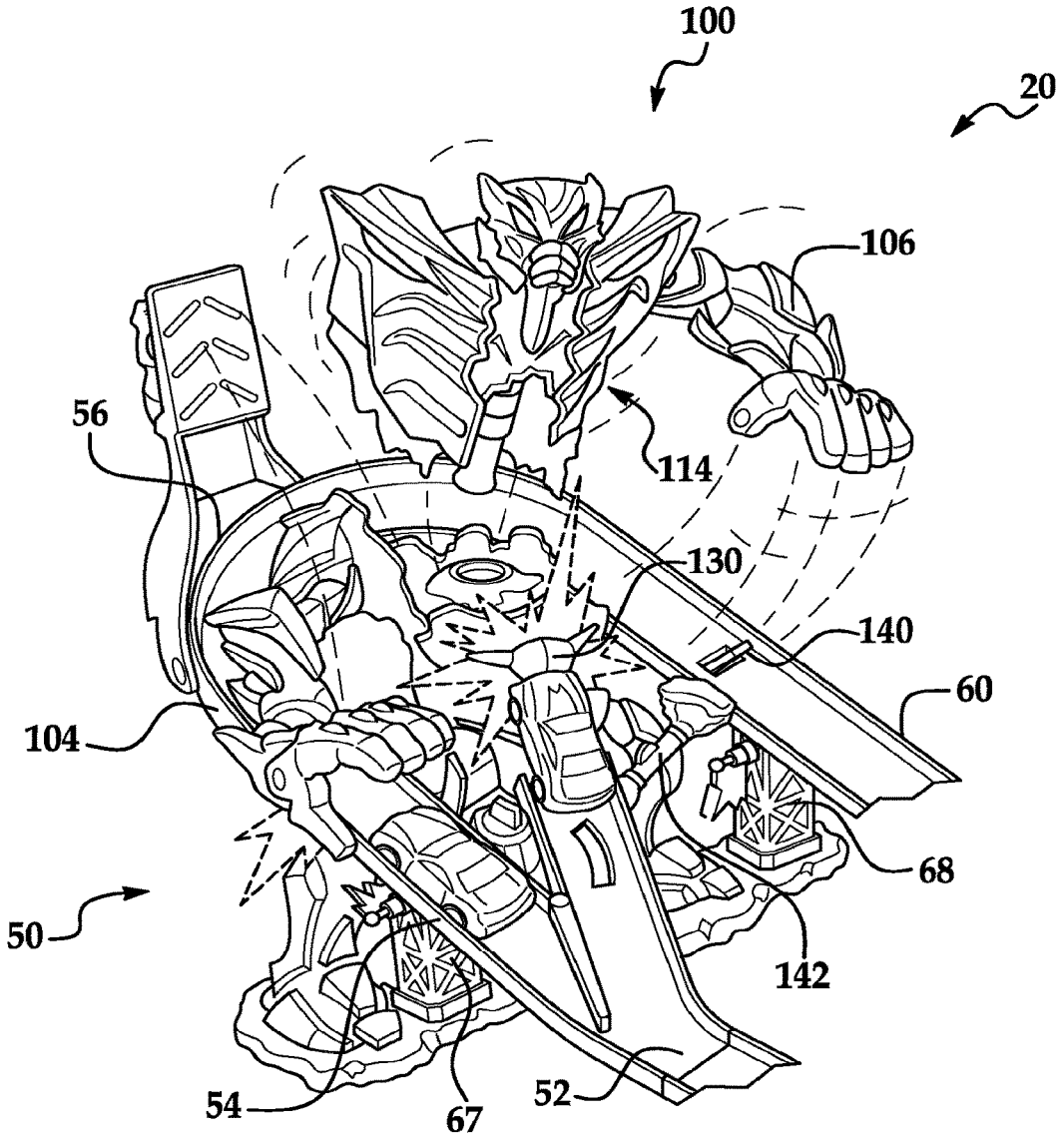
FIG. 4 is a perspective view of the portion of the track set shown in FIGS. 2 and 3 according to an embodiment of the invention.

As shown in FIG. 4, a contact member 140, such as a lever for example, extends from a surface of the second track segment 50 adjacent one of the appendages, for example arm 106. In one embodiment, the contact member 140 is pivotable between a first position generally perpendicular to the second track segment 50 and a second position generally parallel to the second track segment 50. The contact member 140 is coupled to the mechanism of the character 100 that indexes with interactions with a toy vehicle 18 through a linkage 142. Rotation of the contact member 140 from the first position to the second position causes the indexing mechanism (which in one embodiment includes one or more gears) of character 100 to transform the torso 114 to the next consecutive stage. In one embodiment, a second biasing member (not shown), such as a torsion spring for example, biases the contact member 140 back to a first position.

Referring again to FIGS. 1-4, to use the toy track set 20, a toy vehicle 18 is initially positioned adjacent the striker 46 of the launcher 40. Actuation and release of the handle 48 causes the toy vehicle 18 to travel from the first track segment 30 to the second track segment 50. If the diverter 78 is in the second position, the toy vehicle 18 is forced along the alternative path of travel onto the ramp 70. The stop gate 76, arranged in a first position, causes the toy vehicle 18 to veer away from the unconnected end 72 so that the toy vehicle 18 does not crash into the torso of the character 100. If the diverter 78 is in the first position, the toy vehicle 18 will travel along the first linear portion 54 of the second track segment 50 and will be "captured" by the first arm 104 of the character 100 mounted thereto. Capture of the toy vehicle 18 causes the first arm 104 to rotate to a second position out of interference (see FIG. 3) with the path of travel along the second track segment 50. If another toy vehicle 18 is then launched along the second track segment 50, the toy vehicle 18 will engage the contact member 140 positioned adjacent the character's second arm 106. Rotation of the contact member 140 causes the character 100 to transform from a first stage to a second stage, such that the torso 114 of the character 100 expands. The second curved portion 62 of the second track segment 50 is positioned at a downward angle such that the toy vehicle 18 will transfer across the gap 65 between the second track segment 50 and the third track segment 80 and stop on the platform 86 connected thereto.

Repeatedly launching a toy vehicle 18 along the second track segment 50 will cause the torso 114 of the character 100 to transform to its third stage and then its fourth stage. The mechanism used to account for interactions of a toy vehicle with the character 100 is also coupled to the stop gate 76 of the ramp 70. Once a predetermined amount of interactions occur such that the torso 114 of the character 100 is in the fourth stage, the mechanism retracts the stop gate 76. If a toy vehicle 18 is then launched when the diverter 78 is in the second position shown in FIG. 4, the toy vehicle 18 will follow the alternate path of travel onto the ramp 70. The unconnected end 72 of the ramp 70 is positioned adjacent the torso 114 of the character 100. Because the stop gate 76 is in a retracted position, the toy vehicle 18 launched from the ramp 70 will directly impact the torso 114, and therefore the spring-loaded actuator 130, of the character 100. The impact on the spring-loaded actuator 130 causes the torso 114 to separate from the remainder of the character 100, thereby representing the destruction of the character 100. In one embodiment, the actuation of spring-loaded actuator 130 causes the character 100 to be propelled outside of the area of the second track segment 50.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A toy vehicle track set, comprising:
a track segment for a toy vehicle;
a contact member mounted adjacent to the track segment and configured to be actuated by a toy vehicle while the toy vehicle is on the track segment; and
a character adjacent to the track segment, the character including a first portion and at least a second portion movably coupled to the first portion, wherein the at least a second portion moves relative to the first portion in response to actuation of the contact member by a toy vehicle.

2. The toy vehicle track set of claim 1, wherein the track segment includes a surface, and the contact member extends from the surface of the track segment.

3. The toy vehicle track set of claim 2, wherein the contact member is pivotable between a first position generally perpendicular to the surface of the track segment, and a second position generally parallel to the surface of the track segment.

4. The toy vehicle track set of claim 3, wherein the at least second portion moves relative to the first portion in response to the contact member pivoting from the first position to the second position.

5. The toy vehicle track set of claim 2, wherein a toy vehicle is supported on the surface as it travels along the track segment.

6. The toy vehicle track set of claim 1, wherein the first portion is a torso and the at least a second portion is at least a body portion movably coupled to the torso.

7. The toy vehicle track set of claim 6, wherein the at least a body portion includes first and second body portions, the first and second body portions are configured to move relative to the torso in response to actuation of the contact member by a toy vehicle.

8. The toy vehicle track set of claim 7, wherein the character includes a spring-loaded actuator that moves the first and second body portions relative to the torso in response to actuation of the contact member by a toy vehicle.

9. The toy vehicle track set of claim 7, wherein the first and second body portions move away from each other in response to actuation of the contact member by a toy vehicle.

10. The toy vehicle track set of claim 1, further comprising a launcher mounted adjacent to the track segment and configured to launch a toy vehicle along the track segment.

11. The toy vehicle track set of claim 1, wherein the contact member is a lever.

12. A toy vehicle track set, comprising:

a track segment for a toy vehicle, the track segment having a surface;

a contact member extending from the surface and configured to be actuated by a toy vehicle on the track segment; and a transforming character located proximate to the track segment, the transforming character including a torso and at least one body portion movably coupled to the torso, wherein the at least one body portion moves relative to the torso upon actuation of the contact member by a toy vehicle.

13. The toy vehicle track set of claim 12, wherein the at least one body portion includes first and second body portions movably coupled to the torso, and the first and second body portions move away from each other upon actuation of the contact member by a toy vehicle.

14. The toy vehicle track set of claim 13, wherein the transforming character includes a spring-loaded actuator that projects the first and second body portions away from the torso in response to actuation of the contact member by a toy vehicle.

15. The toy vehicle track set of claim 12, wherein a toy vehicle is supported on the surface as it travels along the track segment.

16. The toy vehicle track set of claim 12, further comprising a launcher mounted adjacent to the track segment and configured to launch a toy vehicle along the track segment.

17. A toy vehicle track set, comprising:

a track segment for a toy vehicle;

a contact member located proximate to the track segment and configured to be engaged by a toy vehicle travelling on the track segment; and a transforming character located proximate to the track segment, the transforming character including a torso, a pair of appendages coupled to the torso, and first and second adjacent body portions movably coupled to the torso, wherein a first engagement of a toy vehicle with the contact member causes the first and second body portions to move away from each other to create a gap having a first width between the first and second body portions, and a second engagement of a toy vehicle with the contact member causes the first and second body portions to move away from each other such that the gap between the first and second body portions has a second width larger than the first width.

18. The toy vehicle track set of claim 17, wherein the transforming character includes a spring-loaded actuator separate from the contact member, and the spring-loaded actuator is disposed between the torso and the first and second body portions.

19. The toy vehicle track set of claim 18, wherein the spring-loaded actuator is actuatable by a toy vehicle when the gap between the first and second body portions has at least the second width.

20. The toy vehicle track set of claim 19, wherein the transforming character includes a first portion and a second portion, and wherein the first portion separates from the second portion in response to actuation of the spring-loaded actuator by a toy vehicle.

* * * * *